United States Patent [19]

Karlsson

[11] Patent Number: 4,820,134

[45] Date of Patent: Apr. 11, 1989

[54] LOOP PUMP

[76] Inventor: Per-Olof Karlsson, Box 51, S-980 21 Jukkasjärvi, Sweden

[21] Appl. No.: 67,917

[22] PCT Filed: Oct. 16, 1986

[86] PCT No.: PCT/SE86/00479

§ 371 Date: Jun. 15, 1987

§ 102(e) Date: Jun. 15, 1987

[87] PCT Pub. No.: WO87/02425

PCT Pub. Date: Apr. 23, 1987

[30] Foreign Application Priority Data

Oct. 18, 1985 [SE] Sweden ..... 8504905

[51] Int. Cl.[4] ..... F04B 17/00

[52] U.S. Cl. ..... 417/336; 417/334; 415/88; 416/86

[58] Field of Search ..... 417/334, 336, 94, 61, 417/240, 241, 348, 355; 415/7, 73, 88; 416/85, 86; 290/54

[56] References Cited

U.S. PATENT DOCUMENTS

| | | | |
|---|---|---|---|
| 548,078 | 10/1895 | Miller | 417/336 |
| 896,581 | 8/1908 | Robinson et al. | 417/334 |
| 932,446 | 8/1909 | Combs | 417/334 |
| 932,628 | 8/1909 | Meyer | 417/336 |
| 1,035,055 | 8/1912 | Seaman | 417/334 |
| 1,035,993 | 8/1912 | Moore | 417/334 |
| 1,061,605 | 5/1913 | Gillett | 417/336 |
| 1,293,480 | 2/1919 | Lear | 417/336 |
| 2,730,631 | 1/1956 | Dandini | 417/334 |
| 3,275,198 | 9/1966 | Barlow | 417/336 |
| 3,393,643 | 7/1968 | Herman | 415/7 |
| 4,010,647 | 3/1977 | Kissell et al. | 417/94 |

FOREIGN PATENT DOCUMENTS

| | | | |
|---|---|---|---|
| 249831 | 7/1912 | Fed. Rep. of Germany . | |
| 49489 | 6/1921 | Sweden . | |
| 61817 | 10/1926 | Sweden . | |
| 1427723 | 2/1976 | United Kingdom | 417/94 |

OTHER PUBLICATIONS

Aktiebolaget De Lavals Angturbin, "Pumpteknik", vol. 2, published 1956 by Svenska Tryckeriaktiebolaget (Stockholm), p. 20.

*Primary Examiner*—Donald E. Stout

*Attorney, Agent, or Firm*—Cushman, Darby & Cushman

[57] ABSTRACT

A loop pump (1) for pumping liquid, i.e. a pump comprising a pipe (3) or the like embodied in a plurality of turns/loops. The pipe is rotated by a drive source to introduce alternately air and liquid into an inlet (4) and to pump the liquid to a drawing place by way of a conduit (6) or the like rotatably connected with the pipe. The drive source, which may be a propeller (8), absorbs the flow energy of the liquid. A floating body (10) gives the pump the desired floatability on the liquid and the pump includes an anchor (11) for anchoring it relative to the surroundings of the flowing liquid.

4 Claims, 4 Drawing Sheets

LOOP PUMP

BACKGROUND OF THE INVENTION

This invention relates to a loop pump for pumping liquid, i.e. a pump comprising a pipe or the like embodied in a number of turns/loops, which pipe is rotated by a drive source in order to introduce alternately air and liquid into an inlet and which pipe pumps the liquid to a drawing place by way of a conduit or the like rotatably connected with the pipe.

It is previously known to use so-called loop pumps/-spiral pumps for lifting liquid from a low level to a higher one. Such a pump comprises a pipe bent in several turns/loops to a helical form or a passage made in another way, which pipe or passage is outwardly open at one of its ends to form the intake end/liquid inlet of the pipe and which pipe or passage is connected at its other end by way of a rotatable coupling with a pipe or hose leading to the higher level to which the liquid is to be lifted. During the work of the pump the spiral is partly immersed in the liquid to be lifted so that when the spiral is rotated its intake end will be alternately below and above the liquid level so as to take in alternately liquid and air. The air enclosed in the spiral will be compressed and this compression is successively increased in the helical turns and is maximal in the last turn connected with the outlet. The pump gives off alternately liquid and compressed air to its outlet, and in this way the liquid will be given off intermittently at the outlet of the pump.

Pumps of the above-mentioned type now known are, as far as is known, stationarily installed at their place of use and operated by a drive source requiring "external" energy such as an electric motor or a combustion motor.

SUMMARY OF THE INVENTION

It is the object of this invention to provide a loop pump/spiral pump so embodied that it is driven by flow energy in the liquid, part of which is to be lifted by means of the pump to a higher height level, and this object is achieved in that the pump has been given the characteristic features set forth in the claims.

The inventive pump which is very pro-environmental and silent can thus be placed anywhere in a liquid flow of some type and carry out its lifting of liquid to a higher height level without any supply of other energy than the kinetic energy in the liquid flow being required. Moreover, the inventive pump is so designed that it has inherent floating power, and therefore it need only be anchored in the surroundings of the liquid flow to prevent it from accompanying the liquid flow. This anchoring can be made so that the pump adjusts itself automatically to the prevailing direction of flow.

Thus, the pump of the invention does not require much energy and is reliable, and it can also be used in nature without any problems at very remote and isolated places where intervals between different inspections can be very long for different reasons. Furthermore, it is easy to move the pump between different places of use as its installation is extremely uncomplicated.

DESCRIPTION OF THE DRAWINGS

Illustrative examples of the invention will be described in greater detail in the following with reference to the enclosed drawings, wherein.

DETAILED DESCRIPTION

Figure 1:
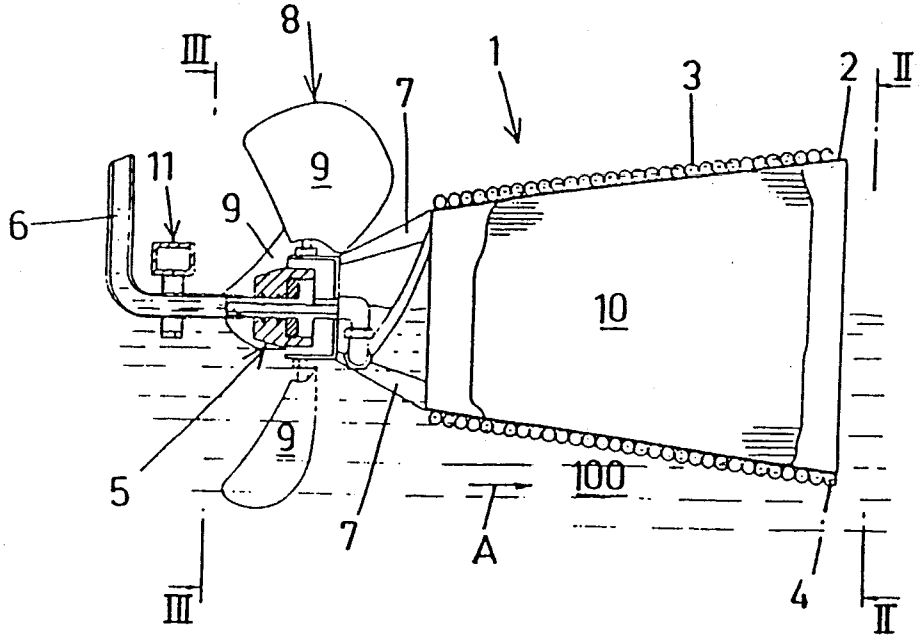
FIG. 1 shows a longitudinal section of an embodiment of an inventive loop pump.
Figure 3:
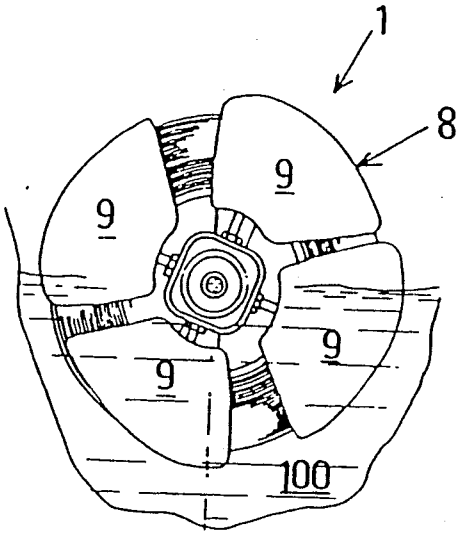
FIG. 3 shows a section III—III of the pump according to FIG. 1.

The loop pump 1 shown in FIG. 1 comprises a conical drum 2 supporting externally a number of turns (loops) of a pipe or hose 3. At one of its ends the hose 3 has an inlet opening 4 being the liquid inlet of the loop pump. At its other end the hose 3 is connected via a so-called swivel coupling (i.e., a rotary joint) 5 with a line 6 for lifting liquid and starting from the pump 1, which line is drawn up to the drawing place to which the liquid is to be pumped. The pipe line 6 is connected with one part of the swivel coupling and the other part of the coupling is connected with the hose 3 and the drum 2. A propeller (i.e., a Vane means) 8 is also connected with the drum 2 via arms 7, the blades 9 of said propeller 8 having such a configuration and inclination that a flow of liquid will make it rotate. A floating body 10 is arranged within the drum 2 and so adapted that it gives the pump 1 a desired floating position. The loop pump can be fixed relative to the surroundings of the liquid as desired by an anchoring device 11 connected with the pipe 6 and then preferably in such a way that the pump can be freely adjusted according to prevailing direction of the liquid flow, the propeller 8 being utilized in the best possible manner.

Figure 2:
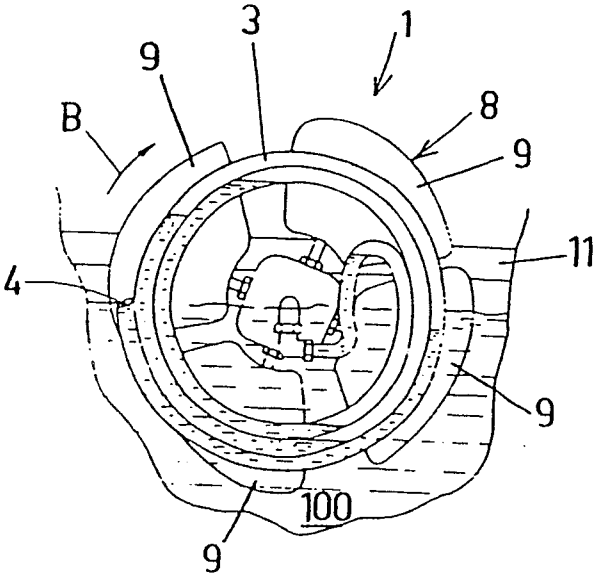
FIG. 2 shows schematically the pump in a view according to II—II according to FIG. 1.

The pump 1 operates as follows. For example, when the pump has been placed so that it floats in a streaming watercourse and has been anchored to the anchoring means 11 in the surroundings of the watercourse the pump 1 will adjust itself automatically relative to the direction of flow of the liquid 100 which is marked by an arrow A in FIG. 1. Moreover, the anchoring means is embodied so that the pump 1 is allowed to enter the floating position predetermined by the choice of the size of the floating body 10. When the streaming liquid 100 acts on the blades 9 of the propeller 8 the propeller 8 and the drum 2 will start to rotate (see arrow B in FIG. 2), with the result that water and air enter alternately through the inlet end 4 of the hose 3 resulting in turn that liquid will be pumped out at a drawing place at the orifice of the conduit 6.

It is advantageous to give the drum 2 the conical form shown as this will involve advantages both in respect of liquid flow and build-up of pressure.

Figure 4:
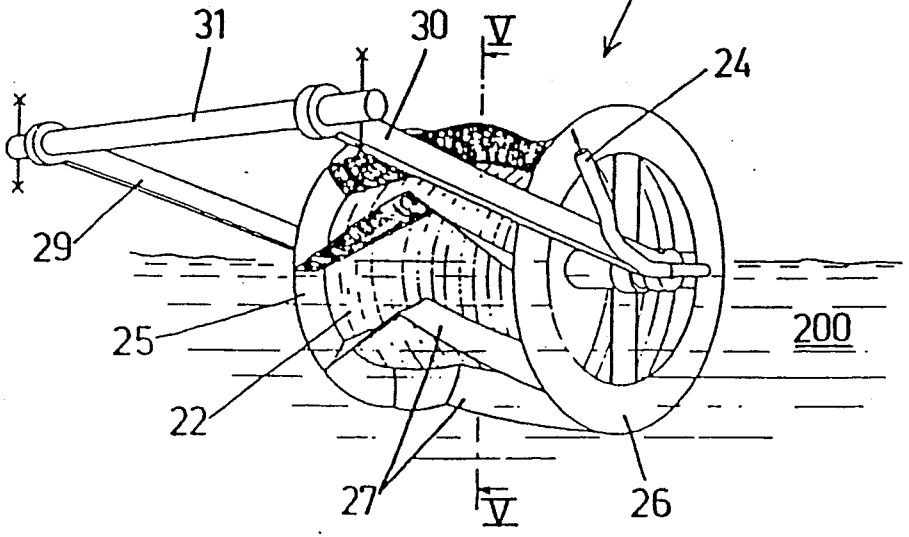
FIG. 4 is a perspective view of an alternative embodiment of the inventive loop pump and FIG. 5 shows a section of the pump according to FIG. 4 taken along line V—V in FIG. 4.

FIG. 4 shows an alternative embodiment of a loop pump according to the invention where a water wheel provided with wings is used instead of an axial propeller. This loop pump 20 comprises a drum 21 supporting a number of turns (loops) of a pipe or hose 22, the hose 22 having an inlet end 23, the other hose end being connected with an outlet line 24 from the pump 20 by way of a so-called swivel coupling, said outlet line 24 leading to a desired drawing place of the liquid pumped by means of the pump. The drum 21 has two end sections 25, 26 and wings 27 are arranged radially between these end sections outside the hose 22, said wings 27 preferably having the V-shape shown in FIG. 4 as this has been found to be suitable with respect to the liquid flow.

A floating body 28 is arranged within the drum 21 and its size is chosen so that the pump 20 obtains the desired floatability. Moreoever, the drum 21 is rotatably connected with two arms 29, 30 which are also connected, preferably articulatedly, with an axle 31. The arms 29, 30 and the axle 31 form together an anchoring means for the pump 20 and the axle 31 is connected in suitable manner with some part of the surroundings of the liquid that is to be pumped to a higher level by means of the pump. The anchorage can preferably be embodied so that the pump 20 adjusts itself automatically according to the prevailing direction of flow of the liquid in which it operates.

Figure 5:
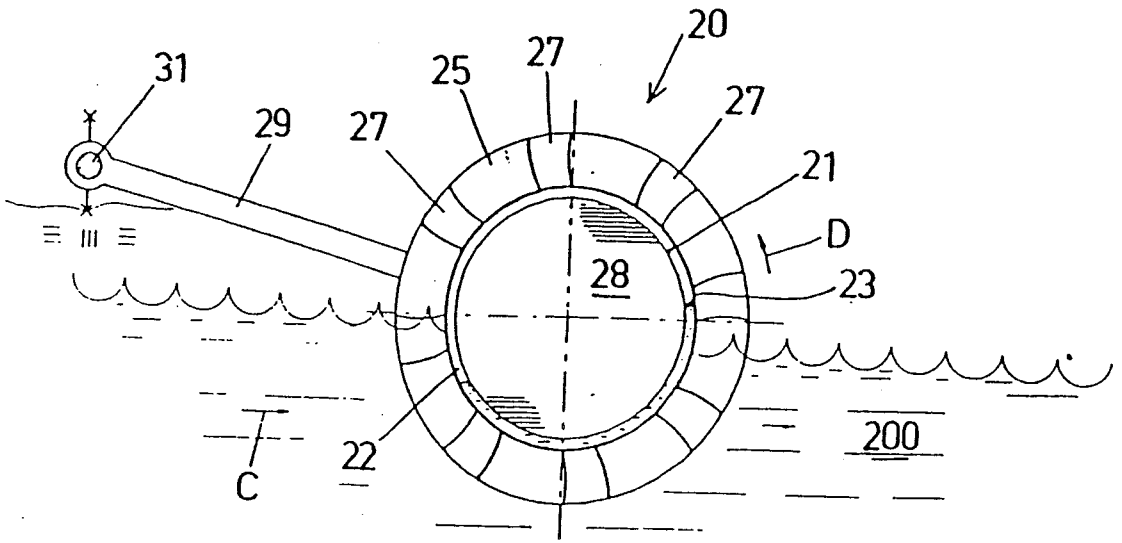

The pump 20 functions as follows. When the pump operates in a liquid 200 having a direction of flow according to arrow C the streaming liquid will act on the wings 27 so that the drum 21 and the hose 22 will rotate according to the arrow D in FIG. 5. Upon this rotation liquid and air will enter alternately through the inlet end 23 into the hose 22 and will then be pumped further through the conduit 24 to the drawing place desired.

It will be appreciated that the inventive loop pump can be embodied in a series of different ways in addition to those described here and this does not apply the least to the embodiment of the very drum. A means in the form of e.g. an external spiral absorbing the flow energy of the liquid can be arranged radially outside the hose loops as an alternative of the propeller and the water wheel. Said means and/of hose loops can also be arranged internally in the drum and of course the placement of the floating body can also be varied.

Thus, the invention is not restricted to what has been shown and described but amendments and modifications thereof are possible within the scope of the following claims.

I claim:

1. A buoyant loop pump for use in a streaming watercourse having a fluid flow direction, comprising:

a pipe arranged about an axis in an axially elongated spiral having a plurality of turns, said pipe having an inlet located off said axis and an outlet located on said axis;

a floating body located at least partly radially within said spiral so as to be radially surrounded at least partially by said pipe;

a vane means connected with said floating body for interacting with said streaming watercourse for converting flow energy of water flowing in said fluid flow direction into rotation of said vane means, floating body and pipe as a unit, whereby alternating quantums of air and water are introduced into said pipe through said inlet, the quantums of air are compressed in said pipe, and said quantums of water and compressed air are expelled from said pipe through said outlet;

an outlet line having an inlet end and an outlet end, said outlet end being located above said axis;

a rotary joint connecting said inlet end of said outlet line to said outlet of said pipe, so that as said vane means, floating body and pipe rotate as a unit said quantums of water and compressed air issue from said outlet end of said outlet line; and an anchor connected to one of said outlet line and a relatively non-rotary end of said rotary joint, and being arranged for tethering said unit for generally pivotal movement in a generally horizontal plane for maintaining alignment of said unit with said fluid flow direction;

said pump being externally substantially frameless, and said rotary joint providing a sole bearing point between said unit and said outlet line.

2. A buoyant loop pump for use in a streaming watercourse having a fluid flow direction, comprising:

a pipe arranged about an axis in an axially elongated spiral having a plurality of turns, said pipe having an inlet located off said axis and an outlet located on said axis;

a floating body located at least partly radially within said spiral so as to be radially surrounded at least partially by said pipe;

a vane means connected with said floating body for interacting with said streaming watercourse for converting flow energy of water flowing in said fluid flow direction into rotation of said vane means, floating body and pipe as a unit, whereby alternating quantums of air and water are introduced into said pipe through said outlet, the quantums of air are compressed in said pipe, and said quantums of water and compressed air are expelled from said pipe through said outlet;

an outlet line having an inlet end and an outlet end, said outlet end being located above said axis;

a rotary joint connecting said inlet end of said outlet line to said outlet of said pipe, so that as said vane means, floating body and pipe rotate as a unit said quantums of water and compressed air issue from said outlet end of said outlet line; and an anchor connected to one of said outlet line and a relatively non-rotary end of said rotary joint, and being arranged for tethering said unit for generally pivotal movement in a generally horizontal plane for maintaining alignment of said unit with said fluid flow direction;

said floating body being a drum having a conically tapered sidewall, a large diameter end and a small diameter end, said pipe being wrapped around said sidewall, and said anchor, in use, disposing said drum with said small diameter end furthest upstream; said outlet of said pipe being juxtaposed with said small diameter end of said drum and said inlet of said pipe being juxtaposed with said large diameter end of said drum.

3. The buoyant loop pump of claim 1 wherein:

said vane means is constituted by a propeller disposed, in use, axially upstream of said small diameter end of said drum.

4. A buoyant loop pump for use in a streaming watercourse having a fluid flow direction, comprising:

a pipe arranged about an axis in an axially elongated spiral having a plurality of turns, said pipe having an inlet located off said axis and an outlet located on said axis;

a floating body located at least partly radially within said spiral so as to be radially surrounded at least partially by said pipe;

a vane means connected with said floating body for interacting with said streaming watercourse for converting flow energy of water flowing in said fluid flow direction into rotation of said vane means, floating body and pipe as a unit, whereby alternating quantums of air and water are introduced into said pipe through said inlet, the quantums of air are compressed in said pipe, and said quantums of water and compressed air are expelled from said pipe through said outlet;

an outlet line having an inlet end and an outlet end, said outlet end being located above said axis;

a rotary joint connecting said inlet end of said outlet line to said outlet of said pipe, so that as said vane means, floating body and pipe rotate as a unit said quantums of water and compressed air issue from said outlet end of said outlet line; and an anchor connected to one of said outlet line and a relatively non-rotary end of said rotary joint, and being arranged for tethering said unit for generally pivotal movement in a generally horizontal plane for maintaining alignment of said unit with said fluid flow direction;

said rotary joint constituting a sole means connecting said unit with said outlet line and said floating body being disposed so as to be substantially completely surrounded by said pipe.

* * * * *